US006899182B2

(12) United States Patent
Davis et al.

(10) Patent No.: US 6,899,182 B2
(45) Date of Patent: May 31, 2005

(54) METHOD OF SCREEN OR PIPE EXPANSION DOWNHOLE WITHOUT ADDITION OF PIPE AT THE SURFACE

(75) Inventors: John P. Davis, Cypress, TX (US); Edwin C. Howell, Houston, TX (US); Steve Rosenblatt, Haddonfield, NJ (US)

(73) Assignee: Baker Hughes Incorporated, Houston, TX (US)

( * ) Notice: Subject to any disclaimer, the term of this patent is extended or adjusted under 35 U.S.C. 154(b) by 45 days.

(21) Appl. No.: 10/141,401

(22) Filed: May 8, 2002

(65) Prior Publication Data

US 2003/0209352 A1 Nov. 13, 2003

(51) Int. Cl.[7] ..... E21B 23/00

(52) U.S. Cl. ..... 166/382; 166/207; 166/212; 166/380

(58) Field of Search ..... 166/380, 382, 166/376, 206, 207, 212

(56) References Cited

U.S. PATENT DOCUMENTS

| | | | | | |
|---|---|---|---|---|---|
| 3,203,483 | A | * | 8/1965 | Vincent | 166/207 |
| 3,358,760 | A | | 12/1967 | Blagg | |
| 4,612,984 | A | * | 9/1986 | Crawford | 166/77.2 |
| 6,012,523 | A | | 1/2000 | Campbell et al. | |
| 6,142,230 | A | * | 11/2000 | Smalley et al. | 166/277 |
| 6,454,013 | B1 | * | 9/2002 | Metcalfe | 166/382 |
| 6,478,091 | B1 | * | 11/2002 | Gano | 166/373 |
| 2002/0046840 | A1 | * | 4/2002 | Schetky et al. | 166/277 |
| 2003/0106697 | A1 | * | 6/2003 | Bode et al. | 166/381 |
| 2003/0141059 | A1 | * | 7/2003 | Mauldin et al. | 166/277 |
| 2003/0141074 | A1 | * | 7/2003 | Freeman | 166/380 |

* cited by examiner

*Primary Examiner*—Hoang Dang
(74) *Attorney, Agent, or Firm*—Steve Rosenblatt

(57) ABSTRACT

A method of streamlining expansion of long lengths of tubulars or screen is disclosed. In one embodiment, the expansion assembly is coupled with a length of pipe that acts as a weight and has a length longer than the anticipated section to be expanded. There is a stinger that fits into the pipe above the anchor and a seal to maintain sealing contact despite the downhole advance of the expansion assembly following each stroke of the expansion device and advance of a swage. By sequentially applying and removing pressure, the desired length is expanded downhole. Alternatively, coiled tubing is connected to the expansion assembly and weights that are above it and is paid out into the well as the expansion assembly descends after each stroke.

21 Claims, 10 Drawing Sheets

Figure 1A:
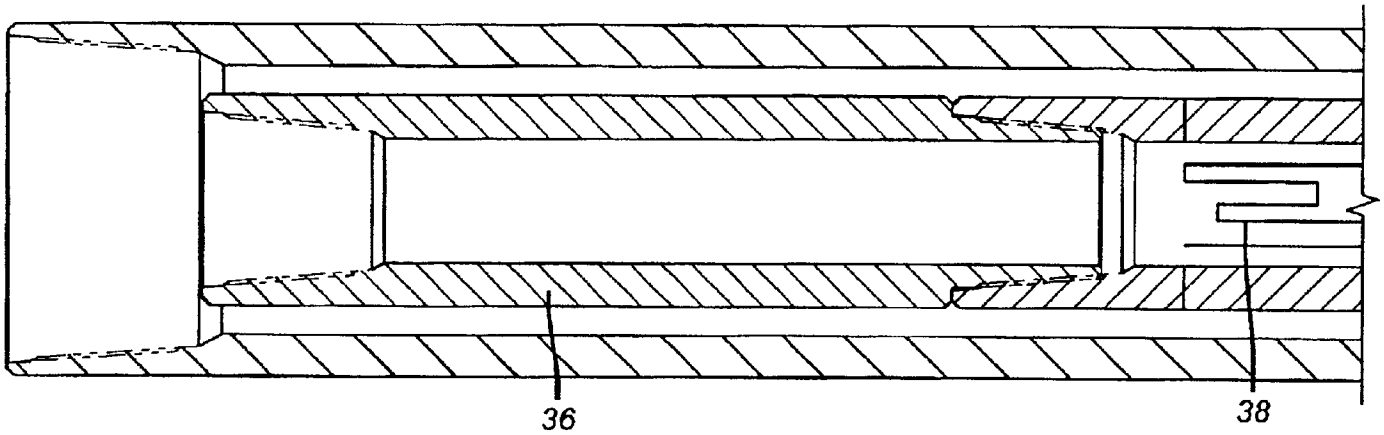
Figure 2A:
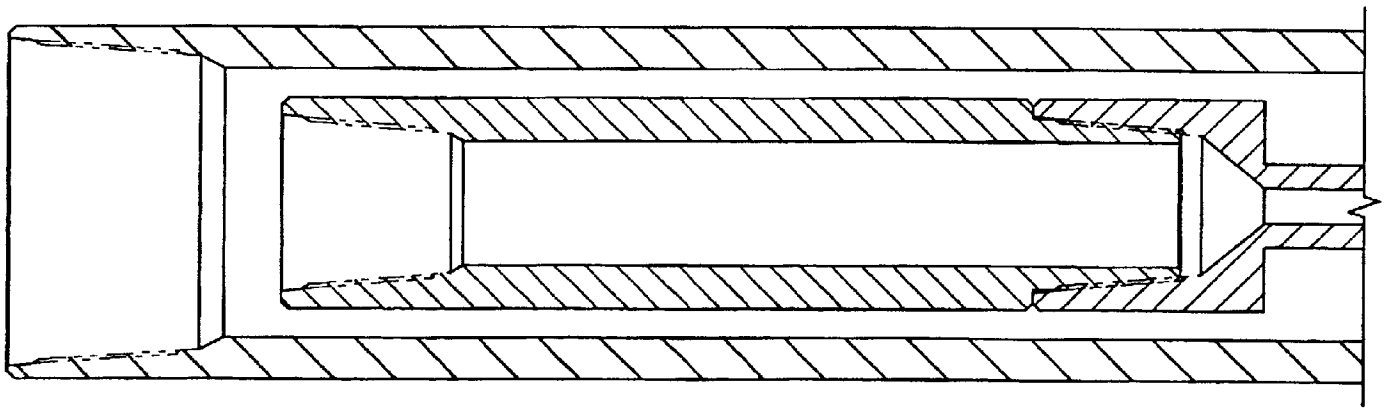
Figure 1B:
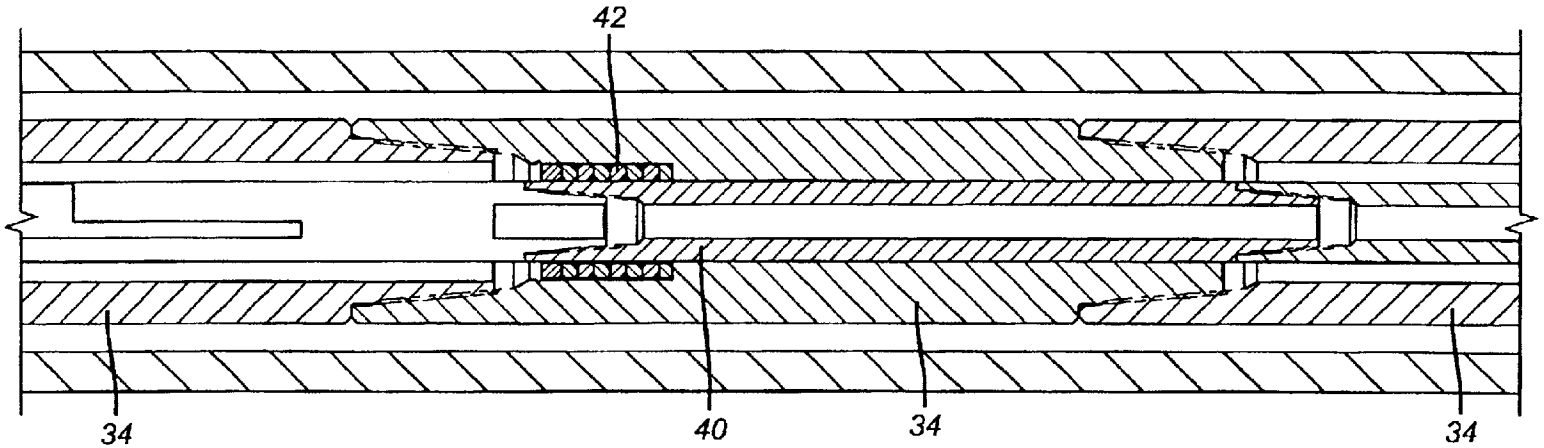
Figure 2B:
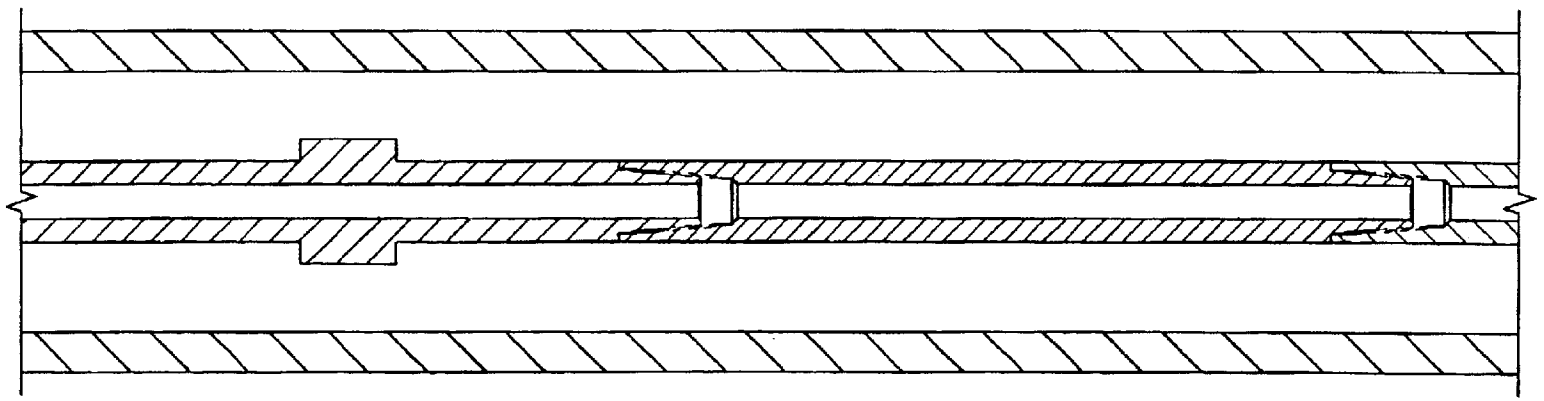
Figure 1C:
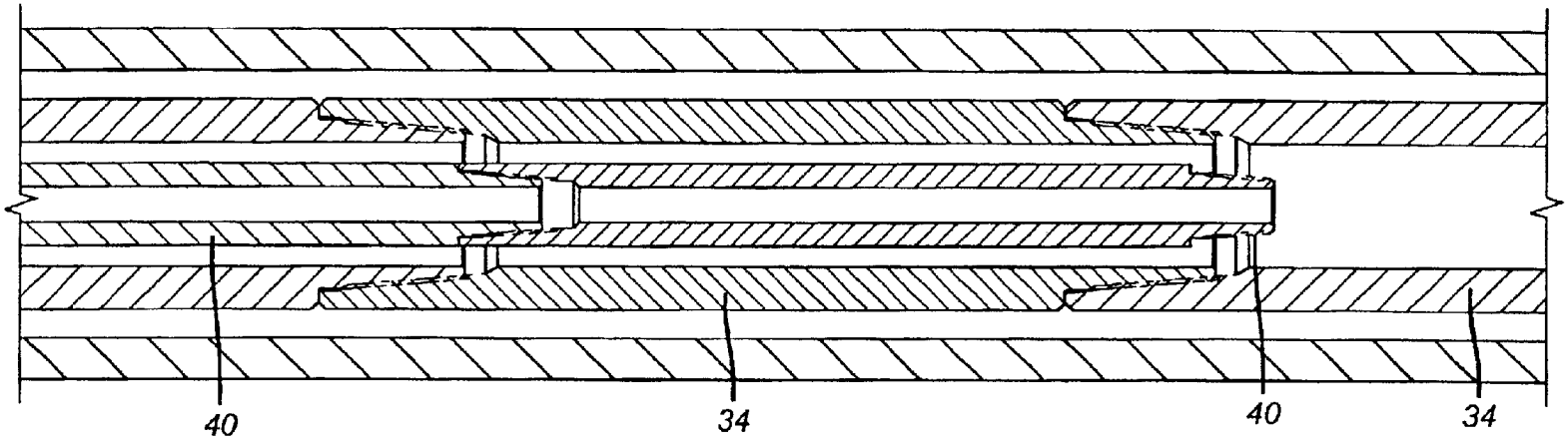
Figure 2C:
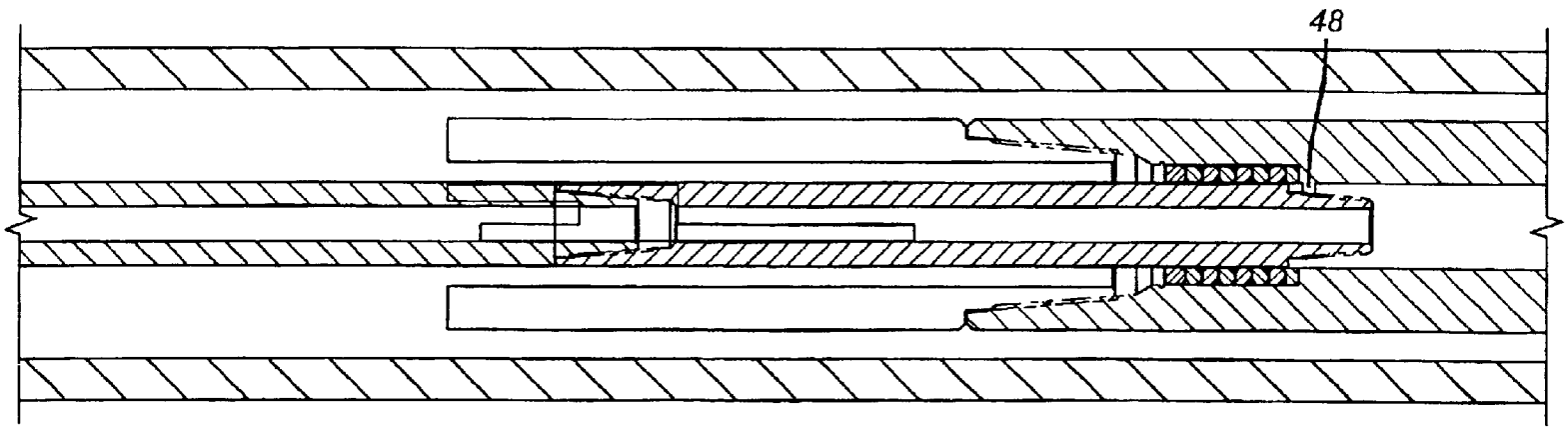
Figure 1D:
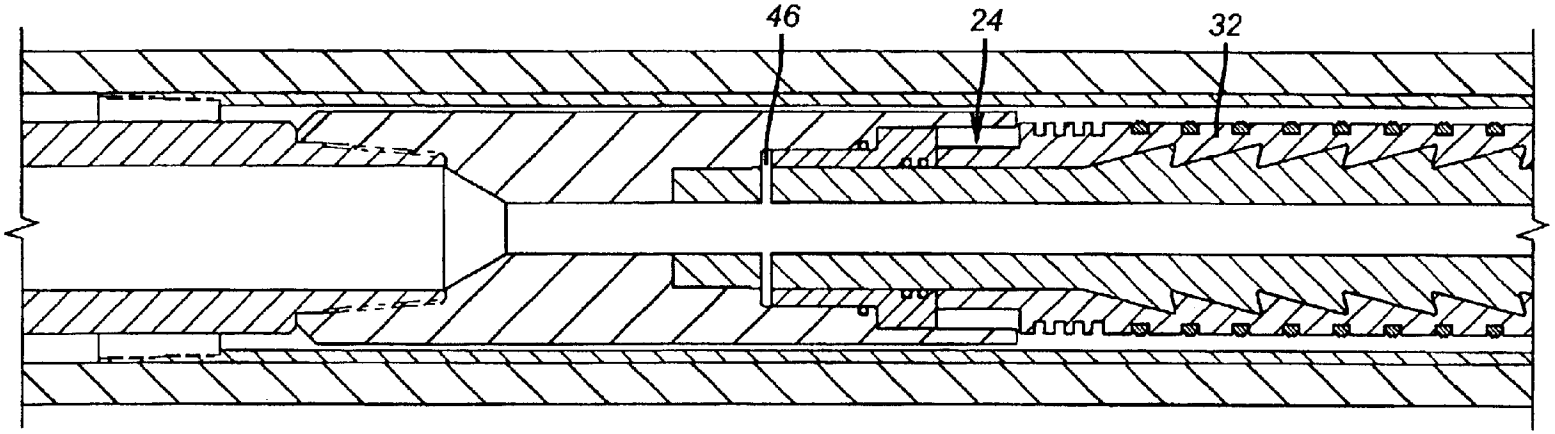
Figure 2D:
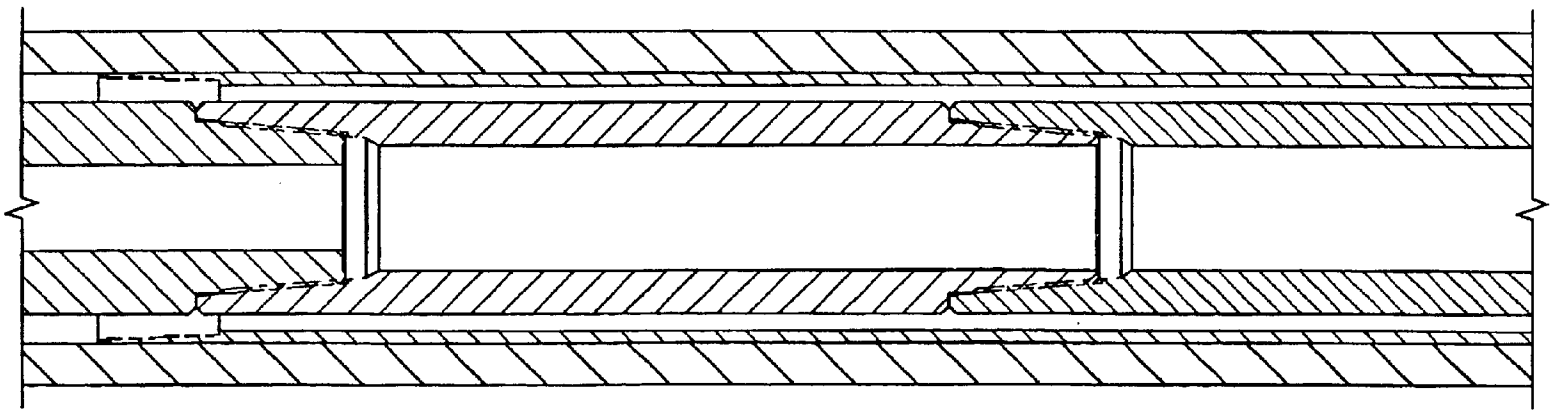
Figure 1E:
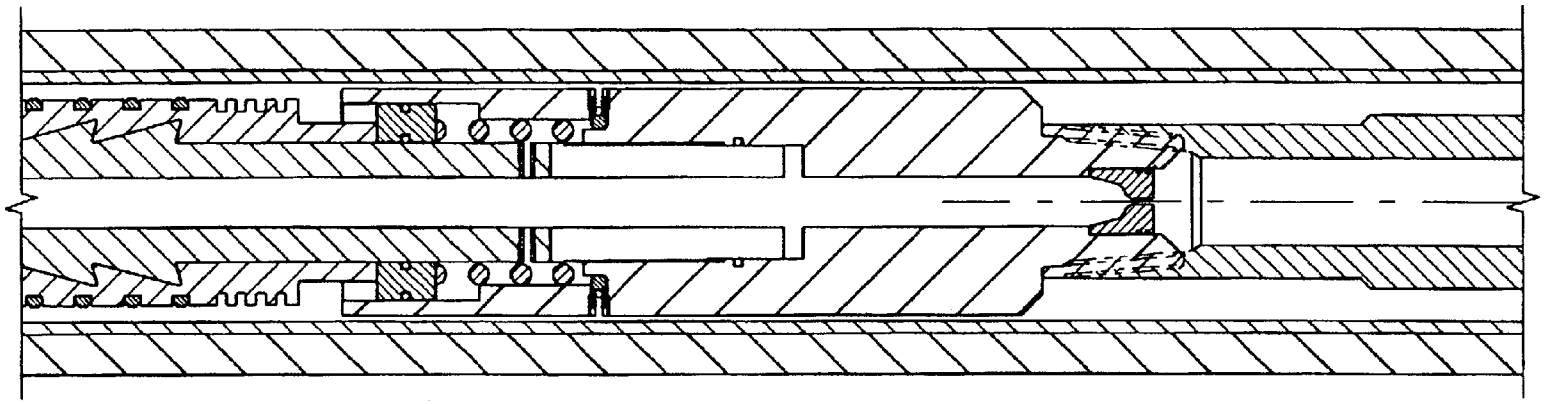
Figure 2E:
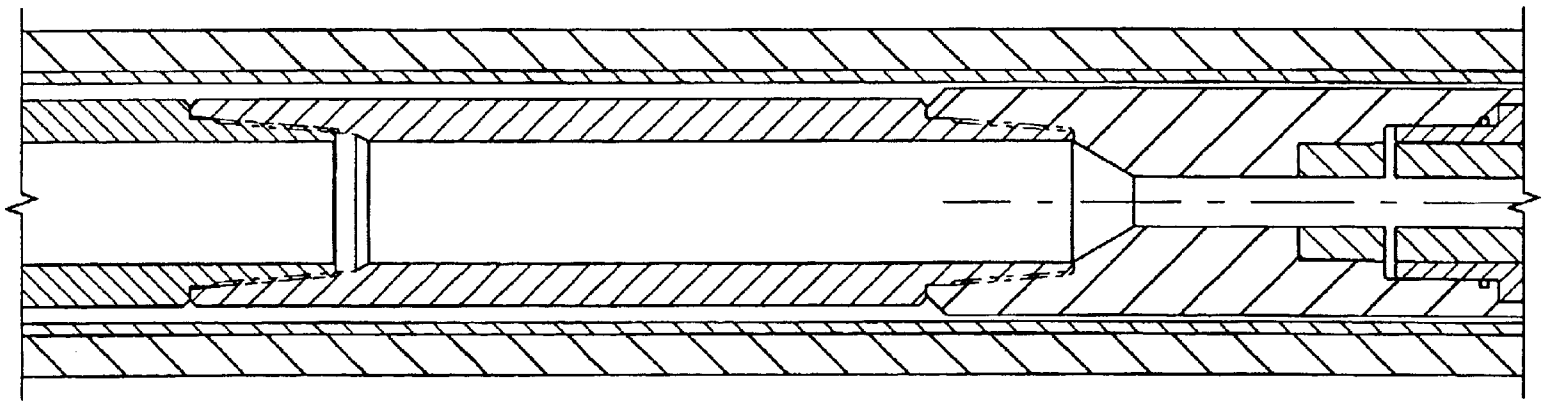
Figure 1F:
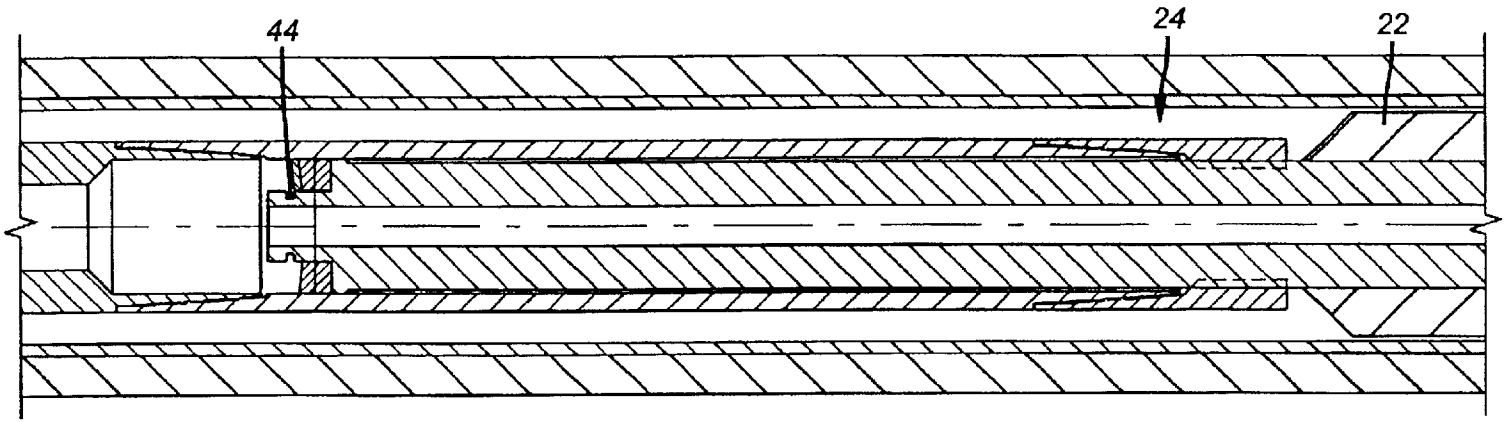
Figure 2F:
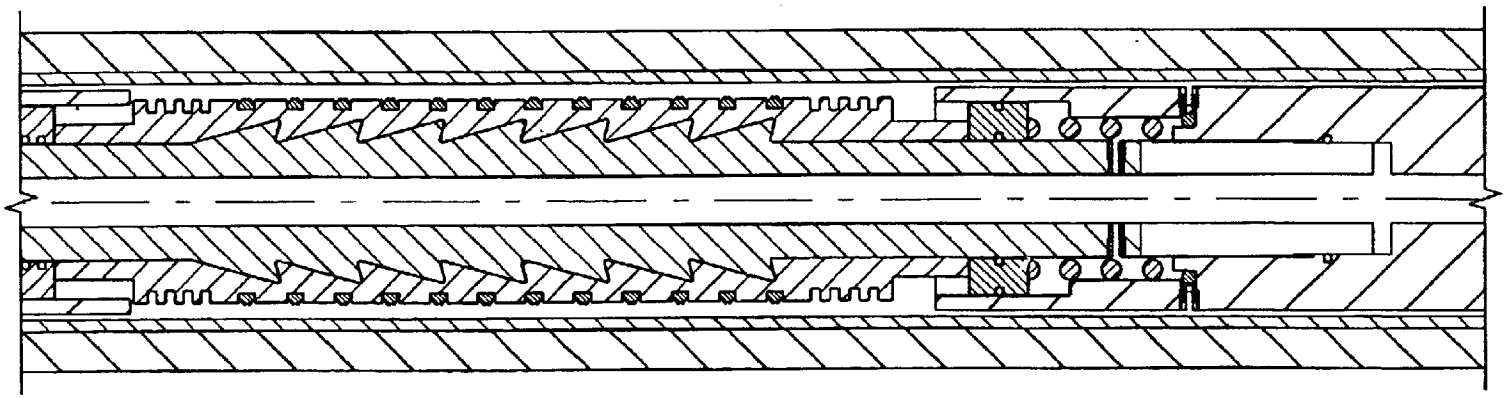
Figure 1G:
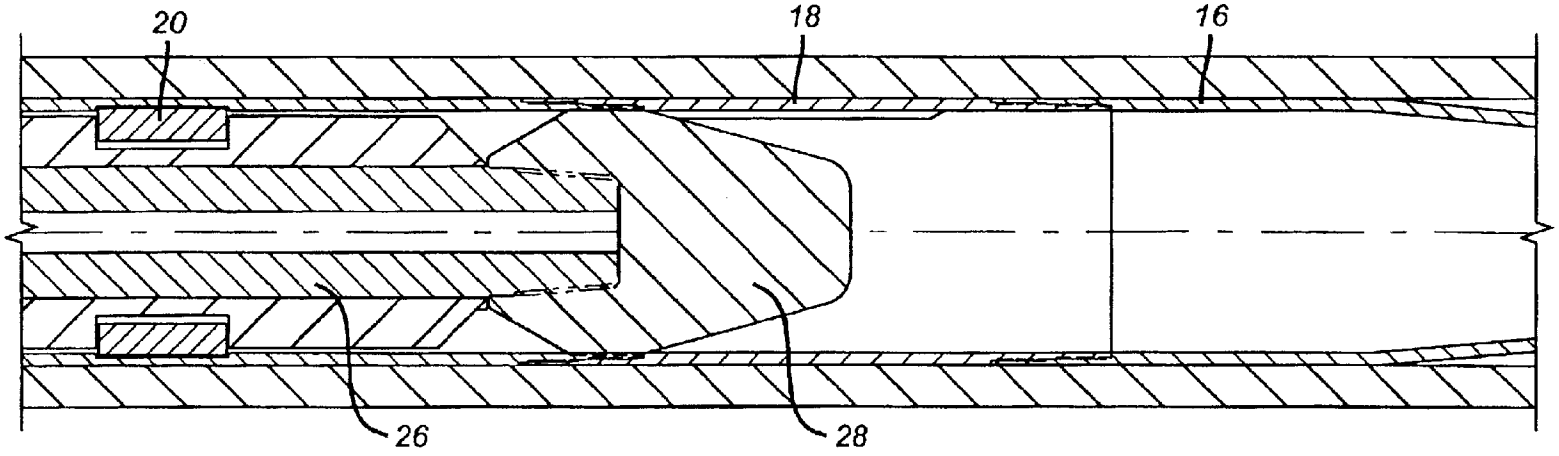
Figure 2G:
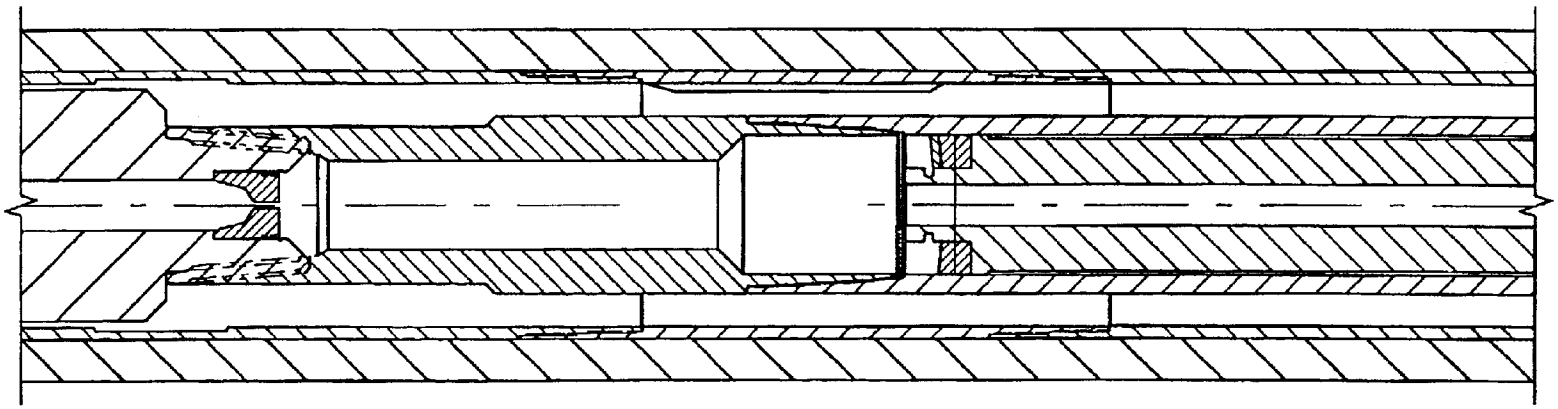
Figure 1H:
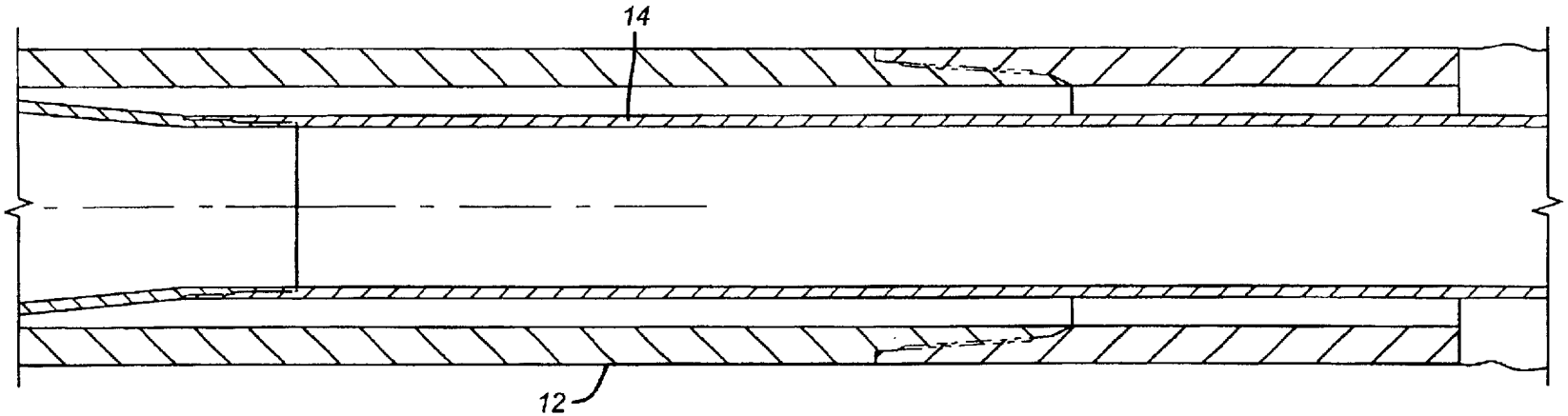
Figure 2H:
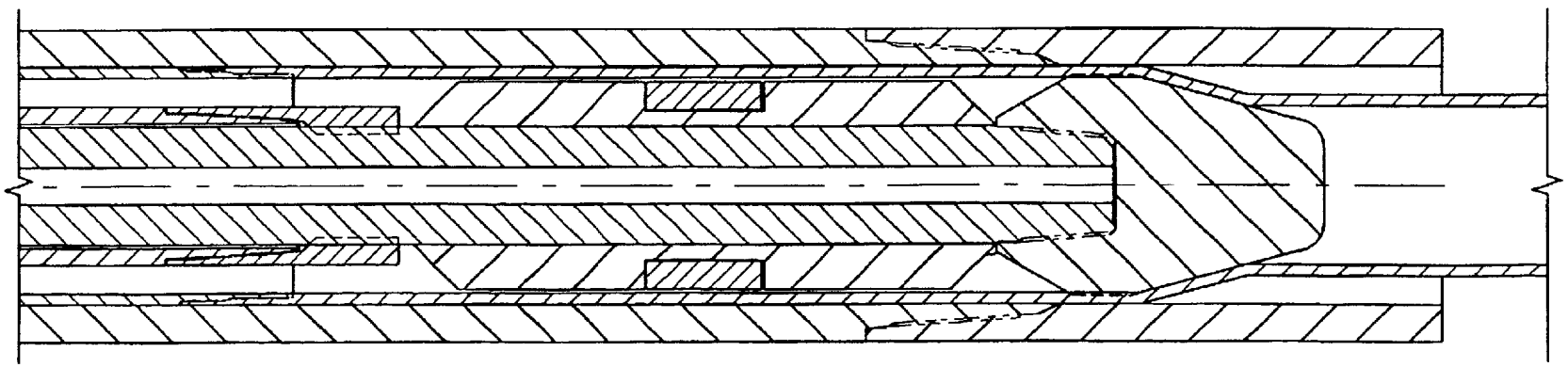

METHOD OF SCREEN OR PIPE EXPANSION DOWNHOLE WITHOUT ADDITION OF PIPE AT THE SURFACE

FIELD OF THE INVENTION

The field of this invention relates to techniques for expansion of tubulars or screen downhole with a swage and more particularly to methods to expedite such procedures.

BACKGROUND OF THE INVENTION

One technique for expansion of tubulars or screen downhole has involved the use of a swage attached to a hydraulic expansion tool. A hydraulically actuated anchor is disposed above the expansion tool. Application of fluid pressure sets the anchor and causes the expansion tool to stroke. At the end of the stroke, the pressure is removed and the anchor releases. At this time, more pipe has to be added at the surface to allow the anchor to move down and re-cock the expansion tool by letting its body move downwardly back over the segment that had previously been telescoped out to initiate the expansion. Pressure is then re-applied and the cycle starts again as another stroke of the expansion tool sends the swage forward for continuing expansion. Many times hundreds, and in some cases even thousands, of feet of tubular or screen have had to be expanded in such a step-wise manner.

The disadvantage of this method is that it is very time consuming to undo the surface assembly each time another stand of pipe needs to be added to further stroke the expansion tool downhole. The addition of stands of pipe required rig down of the pumping equipment each time, followed by a re-connection of the same equipment to let the expansion process continue.

The present invention seeks to optimize this process. It provides for drill collars or other weights above the anchor, to urge it to go downhole after it is released. This feature is particularly useful in horizontal sections in a wellbore. Additionally, a stinger pipe is run into the drill collars so that when the anchor is released, the assembly rides down but remains in sealed contact with the surface pumping equipment. In this manner the expansion can be carried out continuously by application and removal of pressure, with the collars re-cocking the expansion tool automatically as fluid pressure is removed, following a stroke. A provision is made to hold the stinger to the anchor for initial delivery to the expansion location and for simple disconnects preferably using a J-slot assembly.

In an alternative embodiment, the stinger assembly is replaced with a coiled tubing unit. The collars allow the expansion tool to advance when the anchor is released by simply unreeling additional coiled tubing into the wellbore to allow the expansion tool to re-cock. These and other advantages of the present invention will be more apparent to those skilled in the art by a review of the description of the preferred embodiment below as well as the claims.

A few known expansion devices for tubulars are illustrated in U.S. Pat. Nos. 3,358,760 and 6,012,523.

SUMMARY OF THE INVENTION

A method of streamlining expansion of long lengths of tubulars or screen is disclosed. In one embodiment, the expansion assembly is coupled with a length of pipe that acts as a weight and has a length longer than the anticipated section to be expanded. There is a stinger that fits into the pipe above the anchor and a seal to maintain sealing contact despite the downhole advance of the expansion assembly following each stroke of the expansion device and advance of a swage. By sequentially applying and removing pressure, the desired length is expanded downhole. Alternatively, coiled tubing is connected to the expansion assembly and weights that are above it and is paid out into the well as the expansion assembly descends after each stroke.

DETAILED DESCRIPTION OF THE DRAWINGS

Figure 3:
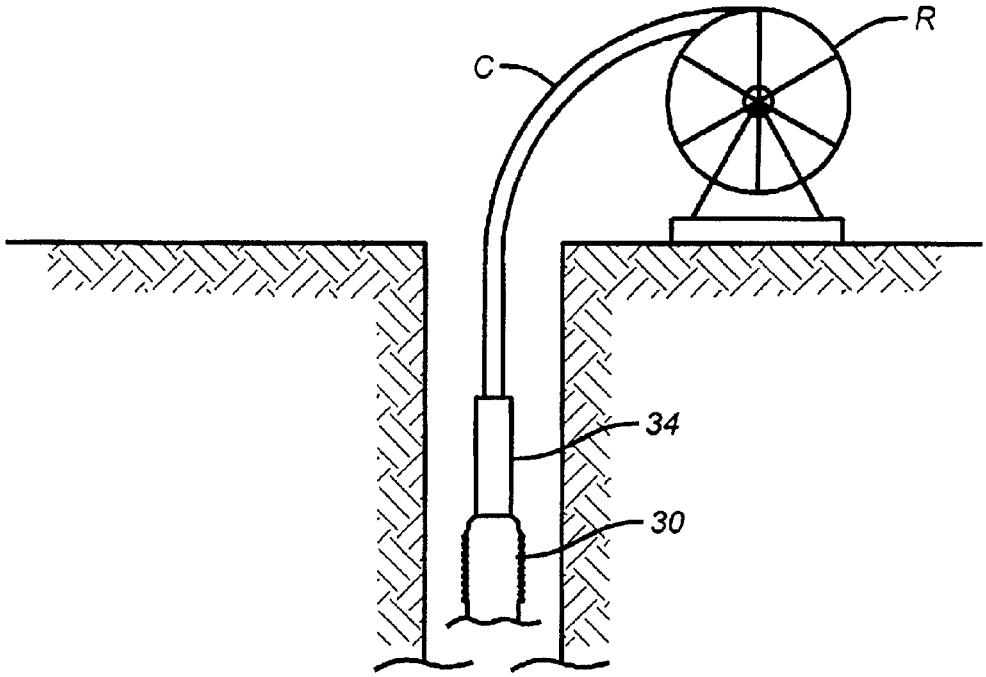
Figure 4:
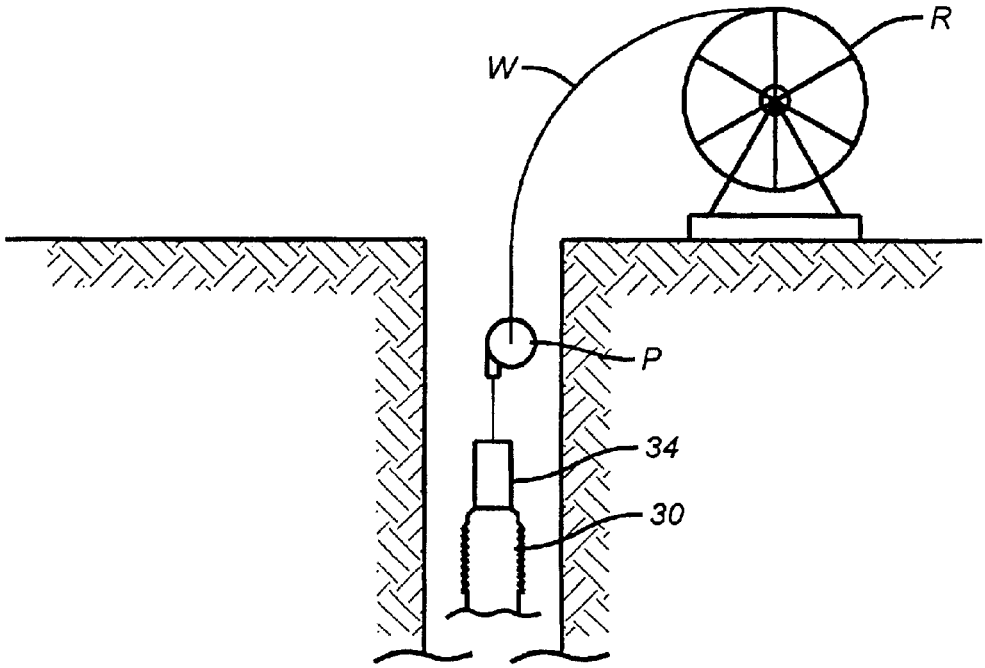

FIGS. 1*a*–1*i* show the assembly in the run in position using a stinger;

FIGS. 2*a*–2*i* show the assembly after several strokes, using a stinger;

FIG. 3 is a schematic view showing the use of coiled tubing connected directly to the anchor shown in FIGS. 1 and 2; and FIG. 4 shows the use of a downhole pump operated by a wireline and connected directly to the anchor shown in FIGS. 1 and 2.

DETAILED DESCRIPTION OF THE PREFERRED EMBODIMENT

Figure 1I:
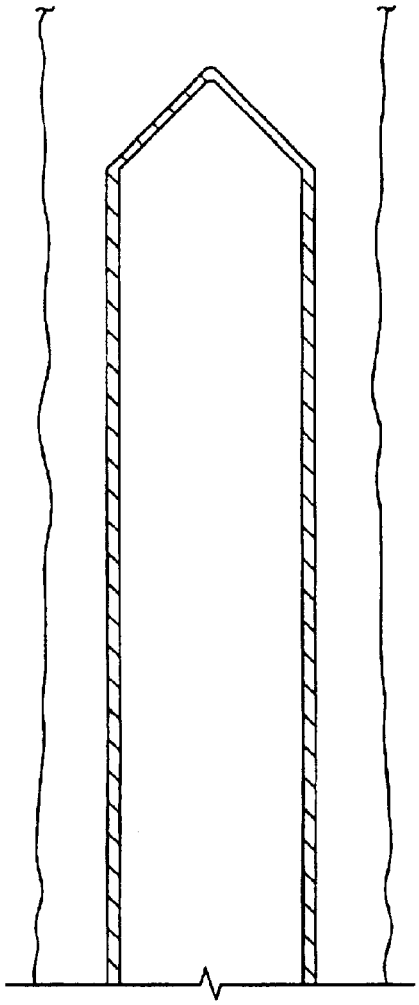
Figure 2I:
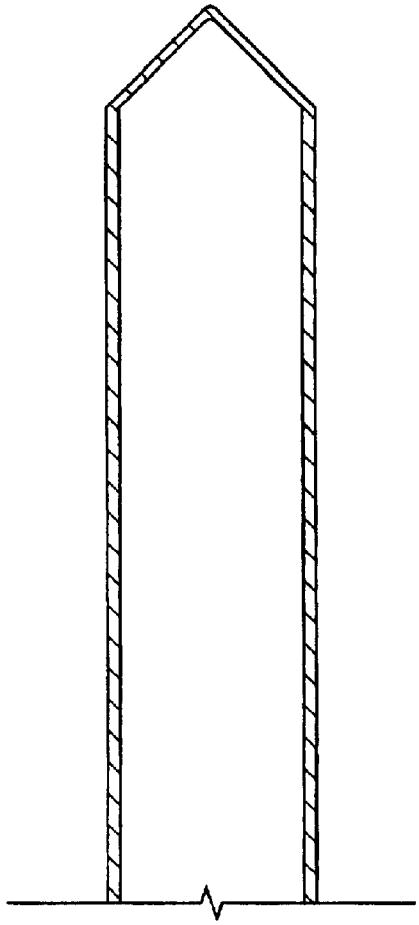

FIG. 1*i* depicts an open hole 10 that is cased to a certain point with casing 12. An assembly of a tubular or/and screen 14 is assembled to a swage bushing 16, which is, in turn, connected to an expandable liner hanger 18. A known releasing tool 20 supported off the body 22 of the hydraulic expansion tool 24 initially holds the liner hanger 18. The hydraulic expansion tool is a known design that features a telescoping member 26 extendable from body 22. A swage 28 of known design is secured at the lower end of telescoping member 26. Above the telescoping member 26 is an anchor 30 of known design. Anchor 30 extends slips 32 when pressure is applied internally to it and releases slips 32 when such pressure is removed. Mounted above anchor 30 are a series of drill collars 34. These collars 34 add weight to urge the anchor 30 further downhole, when pressure is removed in the anchor 30. The length of the collars is preferably longer than the length of tubular and/or screen to be expanded, for reasons that will be explained below. The collars 34 contain a part of a J-slot assembly 38, with the other part located on string 36 that extends from the surface. Other ways of selectively holding the collars 34 to string 36, such as shear pins, can be used as suitable alternatives, although the J-slot is preferred for such selective engagement. String 36 has a stinger 40 extending from it and into the collars 34. There is a stack of chevron seals, or equivalent 42 in the upper end of the collars 34 to allow a sealing sliding contact between the stinger 40 and the collars 34 as the collars 34 progress downhole during the expansion process. The stinger 40 and the collars 34 need to be long enough to stay in sealing contact at seals 42 for the expected length of tubular and/or screen 14 to be expanded. Those skilled in the art will realize that the J-slot assembly 38 incorporates a pin on one member insertable into a slot on the adjacent member to selectively hold them together or to allow release. The pin can be on either member with the slot on the other. Other mechanisms to allow selective retention and release are envisioned in lieu of J-slot mechanism 38, all within the scope of the invention. At the conclusion of the required expansion, the string 36 is advanced downhole, from the position shown in FIGS. 2*a*–2*b* so that the J-slot connection 38 can be used to reconnect the string 36 to the collars 34 for removal of the assembly from the anchor 30 to the swage 28, back to the surface.

The operation of the preferred embodiment will now be described. The assembly as shown in FIGS. 1*a*–1*h* is lowered into position. The screen and/or tubular 14 is secured to body 22 and the swage 28 is adjacent the liner hanger 18. The J-slot assembly 38 holds the collars 34 to the string 36 and the stinger 40 extends into collars 34. The telescoping member 26 is retracted in body 22. A shear pin 44, shown schematically, can secure this initial position. Similarly, the anchor 30 can also be held in the retracted position for run-in by a shear pin 46, shown schematically.

With the assembly in position, pressure is built up to break the shear pins 44 and 46. The anchor 30 extends slips 32 into initial gripping contact with the casing 12 and the telescoping member 26 begins to stroke out of body 22. The advancing swage 28 first expands the expanding liner hanger 18, if used, so that the casing 12 supports the screen and/or tubular 14. There may be enough pipe at the surface to allow the hydraulic expansion tool 24 to stroke twice or about 30 feet with the J-slot assembly 38 holding the collars 34 to the string 36. After that, the J-slot assembly is undone by a turning and lifting or lowering movement so as to allow the anchor 30 and the collars 34 to descend, every time the pressure is removed to cause the slips 32 to release. After each pressure stroke of the hydraulic expansion tool 24, the pressure is removed. The slips 32 release and the collars 34 force down the body 22 over the telescoping member 26. The seal 42 maintains the sealing sliding contact between the stinger 40, which extends from string 36, and the collars 34 mounted above the anchor 30. The swage 28 advances until the entire screen and/or tubular 14 is expanded. The stinger 40 can have a travel stop 48, shown schematically that will limit the descent of the collars 34 to a length longer than the desired expansion length. At the conclusion of the expansion, the string 36 is retrieved from the wellbore and it will bring up the anchor 30 down to the swage 28 with it. Alternatively, the string 36 can be extended at the surface to lower the J-slot assembly 38 back together so as to allow reconnecting the stinger 40 to the collars 34 for the removal of the anchor 30 down to the swage 28.

In another embodiment shown in FIG. 3, the stinger 40 can be eliminated and the string 36 can comprise coiled tubing C connected directly to the collars or equivalent weight 34. Optionally, the collars or weight 34 can be omitted, such as in vertical wells, for example. The procedure is similar, except that as the anchor 30 descends due to the weight of the collars 34 or due to its own weight, when pressure is removed. The descending anchor 30 pulls in more tubing off the tubing reel at the surface. The depth of expansion is then limited to the length of available tubing on the reel at the surface. At the conclusion of the expansion, with the anchor 30 released, the anchor 30 down to the swage 28 are simply retrieved by reeling the coiled tubing back on the reel.

In yet another embodiment, shown in FIG. 4, a wireline W supports a downhole pump P that can be connected to the anchor 30 or the collars 34, if used. Simply by turning the pump P on and off, the swage 28 is advanced into the wellbore in the manner previously described.

It should be noted that the use of collars is optional in vertical or near vertical wells but becomes more necessary if the well goes closer to horizontal. The collars or simply pipe 34 needs to be long enough to retain the sealing contact when using the stinger as the anchor 30 descends. Similarly, the stinger needs to be long enough to allow the anchor 30 to descend while sealing contact around it to the collars 34 is retained.

The above description is illustrative of the preferred embodiment and many modifications may be made by those skilled in the art without departing from the invention whose scope is to be determined from the literal and equivalent scope of the claims below:

We claim:

1. A method of expanding a screen and/or tubular downhole, comprising:

delivering on a string an assembly comprising the screen and/or tubular, a swage connected to a telescoping assembly and a selectively releasable anchor, to a desired depth;

selectively advancing said assembly into the wellbore relative to said string while maintaining sealing contact therebetween; and expanding the screen and/or tubular.

2. The method of claim 1, comprising:

providing weight on said anchor to urge it to move downhole, after said anchor is electively released.

3. The method of claim 1, comprising:

providing at least one tubular member above said anchor.

4. The method of claim 3, comprising:

providing a stinger having a flow path therethrough in flow communication with a lower end of said string;

inserting said stinger into said tubular member; and sealing between said stinger and said tubular member.

5. The method of claim 3, comprising:

selectively connecting said string to said tubular member during run in.

6. The method of claim 4, comprising:

providing a travel stop on said stinger to engage said screen and/or tubular; and retrieving said assembly with said string and said travel stop.

7. The method of claim 4, comprising:

actuating said anchor to grip with pressure;

extending said telescoping assembly with pressure after actuating said anchor to grip;

removing the applied pressure to release the grip of said anchor;

using the weight of said screen and/or tubular to push said anchor down;

re-cocking said telescoping assembly by said downward movement of said anchor; and repeating the procedure of this claim until the desired length of said screen and/or tubular is expanded.

8. The method of claim 7, comprising:

moving said tubular member attached to said anchor with respect to said stinger as said anchor descends; and providing a sufficient length of said tubular member and said stinger to allow said anchor to descend a sufficient distance for the desired length of expansion of said screen and/or tubular while still sealingly engaged to said stinger.

9. The method of claim 8, comprising:

using the weight of said tubular member to advance said anchor and telescoping assembly downhole when said pressure is removed from said anchor.

10. A method of expanding a screen and/or tubular downhole, comprising:

delivering on a string an assembly comprising the screen and/or tubular, a swage connected to a telescoping assembly and a selectively releasable anchor, to a desired depth;

selectively advancing said assembly into the wellbore relative to said string while maintaining sealing contact therebetween; and expanding the screen and/or tubular;

providing at least one tubular member above said anchor;

selectively connecting said string to said tubular member during run in;

initially expanding said screen and/or tubular with said swage to support said screen and/or tubular downhole;

selectively releasing said screen and/or tubular from said string after said initially expanding.

11. The method of claim 10, comprising:

using a J-slot mechanism for said selectively releasing.

12. The method of claim 10, comprising:

selectively rejoining said tubular member to said string after said expanding of said screen and/or tubular is completed, for retrieval of said assembly.

13. A method of expanding a screen and/or tubular downhole, comprising:

delivering on a string an assembly comprising the screen and/or tubular, a swage connected to a telescoping assembly and a selectively releasable anchor, to a desired depth;

selectively advancing said assembly into the wellbore relative to said string while maintaining sealing contact therebetween; and expanding the screen and/or tubular;

providing at least one tubular member above said anchor;

providing a stinger having a flow path therethrough in flow communication with a lower end of said string;

inserting said stinger into said tubular member; and sealing between said stinger and said tubular member;

providing an expandable hanger on said screen and/or tubular as part of said assembly;

releasing from said hanger and said screen and/or tubular after initial expansion; and expanding at least a portion of said screen and/or tubular in open hole.

14. A method of expanding a screen and/or tubular downhole, comprising:

delivering on a coiled tubing string an assembly comprising the screen and/or tubular, a swage connected to a telescoping assembly and a selectively releasable anchor, to a desired depth;

locating said swage, said telescoping assembly and said anchor uphole of said screen and/or tubular;

selectively applying and removing pressure to said assembly; and expanding said screen and/or tubular further with each cycle of application and removal of said pressure.

15. A method of expanding a screen and/or tubular downhole, comprising:

delivering on a coiled tubing string an assembly comprising the screen and/or tubular, a swage connected to a telescoping assembly and a selectively releasable anchor, to a desired depth;

selectively applying and removing pressure to said assembly; and expanding said screen and/or tubular further with each cycle of application and removal of said pressure;

allowing said assembly to descend when pressure is removed; and allowing additional coiled tubing to enter the well to allow said assembly to descend.

16. A method of expanding a screen and/or tubular downhole, comprising:

delivering on a coiled tubing string an assembly comprising the screen and/or tubular, a swage connected to a telescoping assembly and a selectively releasable anchor, to a desired depth;

selectively applying and removing pressure to said assembly; and expanding said screen and/or tubular further with each cycle of application and removal of said pressure;

adding weight to said anchor to force it to descend when said pressure is removed.

17. The method of claim 16, comprising:

actuating said anchor to grip with pressure;

extending said telescoping assembly with pressure after actuating said anchor to grip;

removing the applied pressure to release the grip of said anchor;

using said weight to push said anchor down;

re-cocking said telescoping assembly by said downward movement of said anchor; and repeating the procedure of this claim until the desired length of said screen and/or tubular is expanded.

18. A method of expanding a screen and/or tubular downhole, comprising:

delivering on a wireline an assembly comprising a pump, the screen and/or tubular, a swage connected to a telescoping assembly and a selectively releasable anchor, to a desired depth;

locating said swage, said telescoping assembly and said anchor uphole of said screen and/or tubular;

selectively operating said pump using said wireline;

applying and removing pressure to said assembly by said selectively running and stopping said pump; and expanding said screen and/or tubular further with each cycle of application and removal of said pressure.

19. A method of expanding a screen and/or tubular downhole, comprising:

delivering on a wireline an assembly comprising a pump, the screen and/or tubular, a swage connected to a telescoping assembly and a selectively releasable anchor, to a desired depth;

selectively operating said pump using said wireline;

applying and removing pressure to said assembly by said selectively running and stopping said pump; and expanding said screen and/or tubular further with each cycle of application and removal of said pressure;

allowing said assembly to descend when pressure is removed; and allowing additional wireline to enter the well to allow said assembly to descend.

20. A method of expanding a screen and/or tubular downhole, comprising:

delivering on a wireline an assembly comprising a pump, the screen and/or tubular, a swage connected to a telescoping assembly and a selectively releasable anchor, to a desired depth;

selectively operating said pump using said wireline;

applying and removing pressure to said assembly by said selectively running and stopping said pump; and expanding said screen and/or tubular further with each cycle of application and removal of said pressure;

adding weight to said anchor to force it to descend when said pressure is removed.

21. The method of claim 20, comprising:

actuating said anchor to grip with pressure;

extending said telescoping assembly with pressure after actuating said anchor to grip;

removing the applied pressure to release the grip of said anchor;

using said weight to push said anchor down;

re-cocking said telescoping assembly by said downward movement of said anchor; and repeating the procedure of this claim until the desired length of said screen and/or tubular is expanded.

* * * * *